United States Patent [19]

Woolfson

[11] 4,026,134

[45] May 31, 1977

[54] MAGNETIC LOCK

[76] Inventor: Joseph W. Woolfson, 10 Montague Terrace, Brooklyn, N.Y. 11201

[22] Filed: Dec. 5, 1975

[21] Appl. No.: 638,036

[52] U.S. Cl. ..... 70/276; 70/364 A; 70/413

[51] Int. Cl.[2] ..... E05B 27/04; E05B 47/00

[58] Field of Search ..... 70/276, 413, 363, 364 A

[56] References Cited

UNITED STATES PATENTS

| | | | |
|---|---|---|---|
| 2,966,789 | 1/1961 | Hall | 70/276 |
| 3,270,538 | 9/1966 | Kerr | 70/363 |
| 3,494,157 | 2/1970 | Coker | 70/276 |
| 3,518,855 | 7/1970 | Wake | 70/276 |
| 3,665,740 | 5/1972 | Taniyama | 70/276 |
| 3,782,147 | 1/1974 | Hallmann | 70/276 |
| 3,837,195 | 9/1974 | Pelto | 70/276 |

*Primary Examiner*—Robert L. Wolfe
*Attorney, Agent, or Firm*—Hubbell, Cohen, Stiefel & Gross

[57] ABSTRACT

A magnetic lock having an outer shell with a cylindrical bore therein and a cylindrical plug rotatably mounted in the bore for movement between locked and unlocked positions. The annular plane between the plug and the inner bore surface define a shear plane for the lock. The plug is provided with a longitudinally extending keyway and a plurality of radially extending longitudinally spaced apart passages which communicate with the shear plane but not with the keyway. The shell is provided with a like plurality of passages which align with the plug passages when the plug is in locked position. Disposed within each of the plug passages is a magnetic pin tumbler of length that is less than the length of the plug passages. Drivers are provided which extend from the upper ends of the magnetic pin tumblers to a point within the aligned shell passage to bridge the shear plane and hold the lock in locked position. Means are provided for biasing the magnetic pin tumblers and drivers toward the keyway, which biasing means preferably exert different biasing forces. The key for opening the lock is provided with a shank that is slidably disposable within the keyway. Mounted on the key shank are a plurality of magnets, one for each pin tumbler magnet and poled to repel said pin tumbler magnets and drivers with a force that will be equal and opposite to the force of the biasing means when the confronting ends of the drivers and pin tumblers are in the shear plane, whereby to unlock the lock.

29 Claims, 8 Drawing Figures

MAGNETIC LOCK

BACKGROUND OF THE INVENTION

1. Field of the Invention

This invention relates to locks and particularly to magnetic locks. Most particularly, this invention relates to a magnetic lock which is highly pick resistant.

2. The Prior Art

Magnetic locks have been known for many years. Thus, for example, U.S. Pat. No. 2,931,953 granted to W. Barney on Apr. 5, 1960 discloses a latching device wherein a movable member is locked against movement by a transversely extending magnetic pin which is normally biased into a complementary aperture in a stationary part as by gravity. However, when a key is inserted into the lock, the key carries a magnet that is poled so as to repel the magnetic pin in the movable member whereby to unlock the lock. The problem with a device such as Barney's is that so long as a minimum field strength is provided for the magnet in the key, it will suffice to repel the movable magnetic pin whereby to unlock the Barney lock. This being the case, it is a relatively simple matter to unlock Barney by having two keys with the magnets therein of considerable magnetic strength and being oppositely poled. By a simple trial and error process requiring a maximum of tow trials, the Barney lock could be unlocked. A similar problem is encountered with Felson U.S. Pat. No. 3,111,834 wherein a plurality of magnetic pin tumblers are provided in the plug of the lock, each being biased to bridge the shear plane of the lock by a like poled magnet in the shell. When a key is inserted which bears magnets that are like poled to the pin tumblers, the tumblers will be repelled by the magnets in the key whereby to clear the shear plane and unlock the lock. Again, there is no consideration for the amount of field strength required for the magnets in the key of the Felson lock, so long as a minimum field strength is attained. Thus, for each pin tumbler in the Felson lock, there are only two possibilities. This being the case, the number of keys necessary to cover all possibilities is only $2^n$, where $n$ is the number of mangetic tumblers in the Felson lock. For example, a five-pin tumbler will require only a set of 32 keys, a practical number for a burglar to carry to open the lock.

A similar problem exists in the magnetic lock described in Felson U.S. Pat. No. 3,416,336 which is similar to the earlier discussed Felson patent save for the fact that the pin tumblers are moved by magnetic attraction rather than by magnetic repulsion. The same inherent weaknesses may be found in this patent as in the earlier Felson patent. This is likewise true of the locks described in Wake U.S. Pat. No. 3,518,855.

Other prior art patents known to applicant to disclose magnetic locks are Hallmann U.S. Pat. No. 3,566,637, Hallmann U.S. Pat. No. 3,681,727, Hallmann U.S. Pat. No. 3,782,147 and Pelto U.S. Pat. No. 3,837,195. However, none of the structures described in these patents appears to be as pertinent as the references discussed in detail hereinbefore.

In U.S. Pat. Application Ser. No. 539,285 filed by the applicant herein on Jan. 8, 1975, and in the continuation-in-part thereof, Ser. No. 637961, filed concurrently herewith, the contents of both of which are hereby incorporated by reference in their entireties, a magnetic lock is described and claimed which requires a key having magnets disposed therein for repelling magnetic pin tumblers, which key magnets must not only be poled properly, as was true in the prior art patents discussed above, but which magnets must also be of particular and different field strengths, whereby to render the lock highly pick resistant. However, the structure described in these applications calls for the rotor and stator of the lock to define two radially spaced apart shear planes and for the pin tumbler magnets to be repelled to a location between the two shear planes for unlocking the lock. As will be understood hereinafter, the present application discloses a lock having the advantages of the prior application lock, but requiring only a single shear plane.

SUMMARY OF THE INVENTION

The invention lies in the perception that if magnetic pin tumblers in a plug are of shorter length than the plug passages in which they are slidably mounted, and if each pin tumbler is associated with a driver, and if the pin tumblers and drivers are biased toward the center of the plug, i.e. toward the keyway, then the lock will normally be locked by virtue of the drivers bridging the shear plane. When a key with appropriately poled magnets of proper strength is inserted in a keyway adjacent the pin tumbler magnets, the magnetic pin tumblers will be repelled a distance to position their upward or outer ends in the shear plane, whereby to permit the lock to be turned with the pin tumblers turning with the plug and the drivers staying in the shell. If on the other hand, the magnets in the key are improperly poled, then the pin tumbles and drivers will not move and the lock will remain locked. Moreover, if the magnets in the key are properly poled but not of sufficient strength to repel the pin tumblers to a point where their outer ends are in the shear plane, the the lock will remain locked by virtue of the drivers continuing to bridge the shear plane. Further, and finally if the magnets in the key are properly poled but of too great a strength to merely neutralize the bias on the pin tumbler magnets, then the pin tumblers will be repelled too great a distance and they themselves will move so that their upper ends are within the shell cavity and they will bridge the shear plane to maintain the lock locked. Thus, a single shear plane lock of rather conventional appearance has been devised which requires keys having magnets that are not only properly poled, but are of appropriate and preferably different field strengths in order to open the lock. The biasing means for biasing the pin tumblers towards the keyway may be magnets, springs or gravity of any combination thereof.

DETAILED DESCRIPTION OF THE PREFERRED EMBODIMENTS

Figure 1:
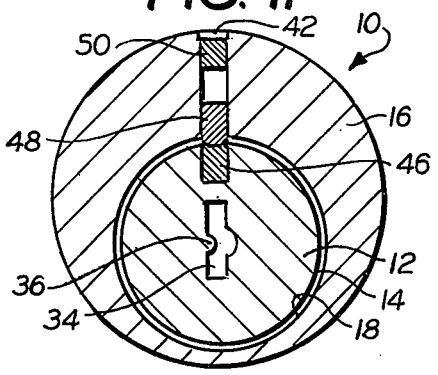
FIG. 1 is a cross-sectional view of a magnetic lock embodying the present invention, which view is taken along the line of 1–1 of FIG. 2.
Figure 2:
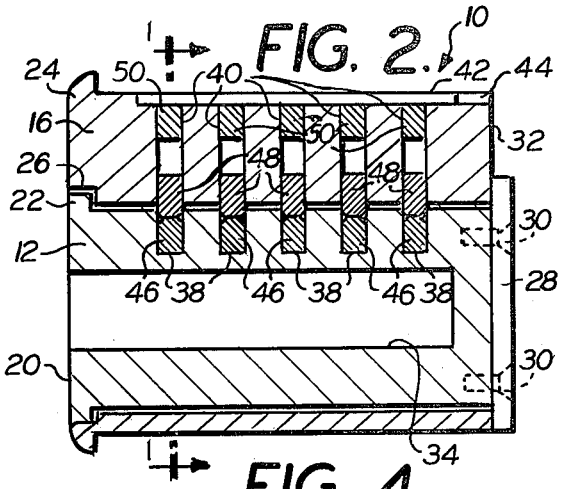
FIG. 2 is a longitudinal sectional view of the lock of FIG. 1 employing magnetic biasing means, the lock being shown in locked condition.
Figure 3:
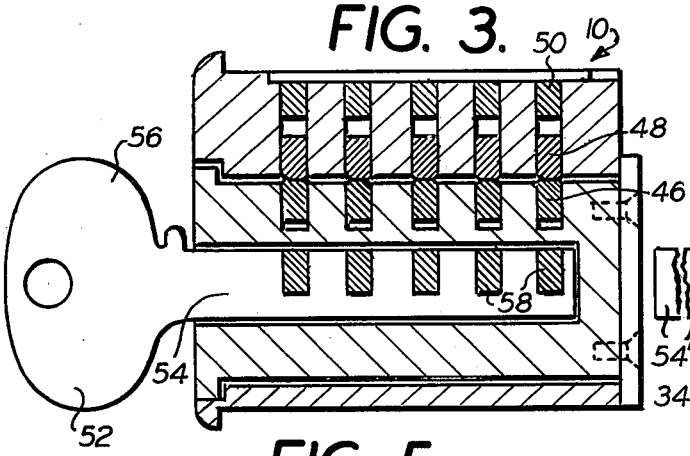
FIG. 3 is a view similar to FIG. 2, but showing an appropriate key disposed in the keyway of the lock to thereby unlock the lock.

Referring to FIGS. 1 to 3, the lock 10 embodying the present invention is illustrated, which lock relies on magnetic bias for the pin tumblers as will become apparent hereinafter. The lock comprises a cylindrical plug 12 that is rotatably mounted in the cylindrical bore 14 of a shell 16, the outer surface 18 of the plug and the close confronting inner or bore surface 14 of the shell defining between them a shear plane for the lock. Plug 12 and shell 16 are made of a non-magnetic material such as, for example, brass. To retain the plug 12 within the shell 16, the front end 20 of the shell is provided with a circular flange 22 and the front surface 24 of the shell is provided with a complementary circular recess 26, whereby to limit the rearward movement of the plug when it is inserted into the lock from the front. Once so inserted, a suitable plate 28 may be secured to the rear surface of the plug as by screws 30 or the like, which plate is circular and of greater diameter than the plug to overlap in sliding relation the rear surface 32 of the shell to thereby prevent withdrawal of the plug in a forward direction.

Preferably, although not necessarily, the plug is not concentric with the shell, but is disposed eccentrically, whereby to save shell material, there being adequate material at the top of the shell for housing biasing means and other elements of the lock as will be described hereinafter, such room not being required at the bottom.

Extending longitudinally of the plug is a keyway 34 which preferably is grooved as at 36 to render it irregular whereby to require a key of particular cross-section for insertion into the keyway. Also provided in the plug is a plurality, here shown as five in number, of radially extending passages 38 which stop short of the keyway 34 and do not communicate therewith. However, they are open at the outer surface 18 of the plug to communicate with the shear plane of the lock.

Provided in the upper end of the shell 16 is a like plurality of through passages 40 which have the same longitudinal spacing as the plug passages 38 which renders the two groups of passages registrable when the lock is in its locked position as shown in FIG. 1. A suitable sliding cover 42 is disposed in a groove 44 along the upper element of the shell 16 is alignment with the outer openings of the through passages 40 to provide for access to said openings for construction and maintenance of the lock. This feature, although desirable, is not necessary and other means may be provided. It will be also apparent as this description proceeds that the passages 40 in the shell 16 need not be through passages, but they could be discontinuous, at least in certain of the embodiments of the invention.

Slidably disposed within each of the plug passages 38 is a pin tumbler magnet 46 which may be of any desired field strength. The pin tumbler magnet 46 may be made of magnetized steel, although preferably, they are made of stronger field strength materials such as any of the variety of materials designated as Alnico. In addition, they may be made of some of the new super magnetic materials such as, for example, salurium cobalt. Many of the stronger magnetic materials are generally of the sintered variety, whereby to render them somewhat weak in shear strength. To overcome this deficiency if desired, the magnetic material in the pin tumbler magnets 46 may be disposed within an outer hardened jacket which will provide the necessary shear strength for the magnets 46. Each of the pin tumbler magnets 46 is of a length that is less than the length of the plug passage 38 in which it is disposed so that when the magnets 46 are in their lowermost position as shown in FIGS. 1 and 2 toward which position they are constantly biased by means to be described hereinafter, the upper ends of the pin tumbler magnets will be disposed below the shear plane.

In accordance with the present invention, disposed above the pin tumbler magnets 46 in end-to-end relation are a plurality of drivers 48, which drivers are of a length greater than the length difference between the pin tumbler lengths and the plug passage lengths so that they will extend beyond the shear plane in the position shown in FIGS. 1 and 2, but of a length less than the available length of movement of the drivers so that under certain circumstances, the drivers can be retracted above the shear plane to bring the pin tumbler magnets into bridging relation with the shear plane to maintain the lock in locked condition. For reasons which will become apparent hereinafter, the confronting ends of both the drivers 48 and the pin tumbler magnets 46 are preferably somewhat beveled.

In accordance with the embodiment of the invention shown in FIGS. 1 and 2, a biasing means is included for biasing the pin tumbler magnets 46 and the drivers 48 to their lowermost position adjacent the keyway, which biasing means are a plurality of magnets 50 that are pressfitted into the upper ends of the plug passages 40. Clearly, with magnetic biasing means as illustrated in FIGS. 1 and 2, the passages 40 need not be through passages, but could function equally well if there were separate cavities in the upper surface of the plug for receiving the magnets 50 and blind end passages extending upwardly from the shear plane to a point somewhat below the magnet cavities. In either event, the magnets 50 are poled to repel the pin tumbler magnets 46 to hold them in the lowered position wherein the drivers all bridge the shear plane of the lock and maintain it locked. Preferably, the magnets 50 are not of the same field strength, but are of different field strengths whereby to bias the pin tumbler magnets with differing forces. The importance of this will become apparent hereinafter. It will also be apparent to those skilled in the art that in the embodiment of FIGS. 1 and 2, the drivers 48 themselves are preferably non-magnetic so that they will be unaffected directly by the biasing magnets 50 and the key magnets 58. Alternatively, drivers 48 could be magnetic and poled the same as their associated pin tumbler magnets.

Depending upon the strength of the biasing magnets 50 and on the strength of the pin tumbler magnets 46, the pin tumbler magnets 46 will be biased towards the keyway by a given amount of magnetic force. In addition, assuming a vertical orientation for the pin tumblers, there will be a gravitational bias added to the magnetic bias. For the purposes of simplicity of description and claiming of the FIGS. 1 and 2 embodiment, as well as the spring bias embodiment of FIGS. 5 and 6 to be described hereinafter, the effects of gravity will be ignored, although clearly, they must be taken into account in actually constructing the lock. This is clearly well within the ability of the skilled art worker.

To open the lock 10, a key 52 is required, which key 52 is provided with a shank 54 of appropriate cross-section for insertion into the keyway 34 and preferably with an enlarged handle or finger grip 56. Distributed along the length of the shank 54 for registration with the pin tumblers 46 are a plurality of magnets 58, which magnets are poled to repel the pin tumbler magnets 46. However, in accordance with this invention and in distinct contrast with all known prior art save applicant's own applications which have heretobefore been described, the mere appropriate holding of the magnets 58 to repel the pin tumbler magnets 56 will not of itself unlock the lock 10. By virtue of the fact that the drivers 48 are included, it will be apparent that if a key magnet 58 is properly poled to repel the magnet 46 but of insufficient strength to overcome the bias of the biasing magnet 50 to the extent that the upper end of the magnet 46 will move into the shear plane of the lock, the lock will remain locked due to the fact that the driver 48 will continue to bridge the shear plane. On the other hand, if the key magnet 58 is properly poled for repelling the pin tumbler magnet 46, but is of such field strength that it more than overcomes the bias of the magnets 50 so as to cause the drivers and the upper ends of the pin tumbler magnets to be repelled to a position in which the upper ends are in the plug passage, whereby to cause the pin tumbler 46 to bridge the shear plane, the lock will remain locked. It is only when the key magnets 58 are properly poled to repel the pin tumbler magnets 46 with a force that will be equal and opposite to the biasing force from the biasing magnets 50 when the upper ends of the pin tumbler magnets are in the shear plane that the pin tumbler magnets will be capable of being moved. Thus, unlike prior art locks (excepting applicants's own lock in the aforementioned applications) wherein the number of keys required to open any five-pin magnetic lock would be $2^5$, there being only two polar possibilities for moving the pin tumbler to the unlocked position, if a lock of the construction of FIGS. 1 and 2 is employed wherein the biasing magnets 50 are capable of yielding any of four different field strengths, then in a five-an tumbler lock the number of possible key combinations will be $8^5$ (i.e. [2×4]5) or 32,768. In a six-pin lock, the possible number of key combinations given four different field strengths for the biasing magnets 50 will be $8^6$ or 262,144. Moreover, there is essentially no way to decode or pick a lock of the type shown in FIGS. 1 and 2. To the best of applicant's knowledge and information, no field strength deletion device can be employed to measure the strength of the magnets 50 by inserting a probe into the keyway 34, as interposed between those magnets 50 and such a probe will be the pin tumbler magnets 46. Since the field strengths of magnets 46 may also vary, they will mask the true field strengths of the magnets 50. Clearly, there is no way of mechanically moving the pin tumblers to bring their upper ends into the shear plane as there is no access to said pin tumblers through the keyway. Thus, a highly secure locked is provided.

Figure 4:
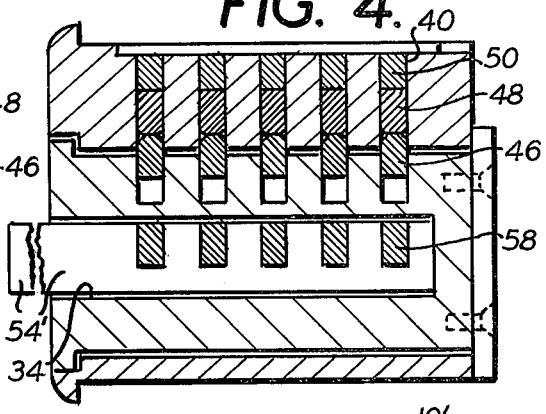
FIG. 4 is a view similar to FIG. 3 illustrating what occurs when an improper key is inserted into the keyway of the lock of FIGS. 1 to 3.

To illustrate the pick resistance of the lock, reference is made to FIG. 4 in which an unauthorized key 54' is inserted into the keyway 34, which unauthorized key is provided with a plurality of magnets 58 here shown to all be poled correctly to repel the pin tumbler magnets 46. However, in the illustration of FIG. 4, it is assumed that the magnets 58 are of too great field strength and they thereby overwhelm the strength of the magnets 50 whereby to force the pin tumbler magnets up into the shell passages 40 to cause the pin tumblers 46 themselves to bridge the shear plane and maintain the lock in a locked position. Clearly, if the magnets 58 were properly poled and of too small strength, the pin tumblers would move upwardly a small distance but not sufficiently to bring their upper ends into the shear plane. Thus, lock 10 would remain locked by virtue of the drivers 48 continuing to bring the shear plane. Finally, if the magnets 58 are not properly poled, there will be no upward movement of the pin tumbler magnets, but instead they would be held more strongly in their lower position whereby to maintain the lock locked.

Figure 5:
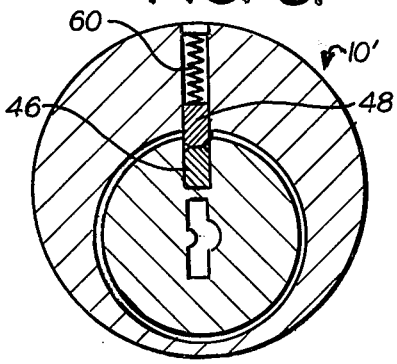
FIG. 5 is a cross-sectional view of another form of lock embodying the present invention, which view is taken along the line 5—5 in FIG. 6 and illustrates a lock employing spring biasing means.
Figure 6:
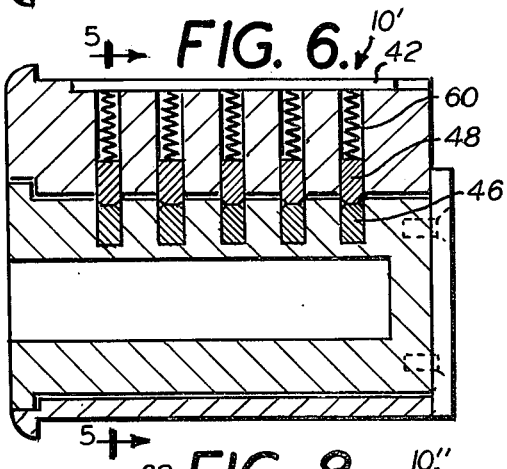
FIG. 6 is a longitudinal sectional view of the lock of FIG. 5.

Referring now to FIGS. 5 and 6, a modified lock 10' is shown, which lock is essentially identical to the lock 10 described in connection with FIGS. 1 to 4 save for one alteration. Specifically, in lieu of the biasing magnets 50 of the FIGS. 1 to 4 embodiment, the biasing means employed in the lock of FIGS. 5 and 6 by way of example are compression springs 60 which bear at their upper end against the sliding plate 42 and bear at their lower end against the drivers 48. Preferably, the springs 60 bias the pin tumblers 46 and the drivers 48 with different forces. It will be apparent that with minor modification well within the ability of the ordinary person skilled in the art, tension springs can be substituted for compression springs. As was true ie in the FIGS. 1 and 2 embodiment, the opening of the lock 10' is accomplished by the use of a key 52 having a plurality of magnets 58 that are poled to repel the pin tumbler magnets 46 with a force that will be equal and opposite to the force of the associated springs when the upper ends of the pin tumbler magnets 46 are in the shear plane. By varying the bias on the springs, a large number of different keys can result, whereby to render the lock essentially pick proof.

It will be recognized that the lock of FIGS. 5 and 6 could be modified by disposing the compression springs in the plug cavities 38 to bias drivers and pin tumblers disposed thereabove away from the keyway 34. Without a key inserted, the lowermost of the driver and pin tumbler magnet, which will preferably although not necessarily be the driver, will bridge the shear plane to maintain the lock locked. This being the case, in order to unlock the lock, the pin tumbler magnets must be attracted, i.e., drawn downwardly, when a key is inserted into the keyway, whereby to require the key magnets to be poled for attraction rather than repulsion. Clearly, the key magnets will also have to have the appropriate field strengths in order to dispose the upper end of the lower of the driver and pin tumbler magnet, already stated to be preferably the driver, in the shear plane.

Additionally, if desired, opposed springs may be disposed in both the plug cavities 38 and the shell cavities 40 in order to reduce and possibly more accurately control the extent of the bias on the pin tumbler magnets.

Figure 7:
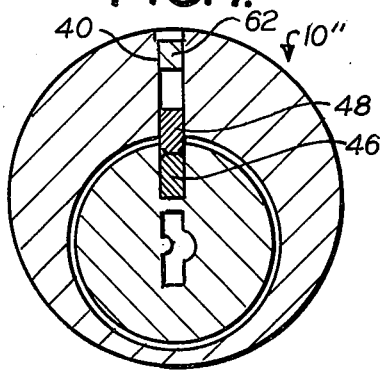
FIG. 7 is a cross-sectional view of yet another form of lock embodying the present invention, which lock relies on a gravity bias, which view is taken along the line 7—7 in FIG. 8.
Figure 8:
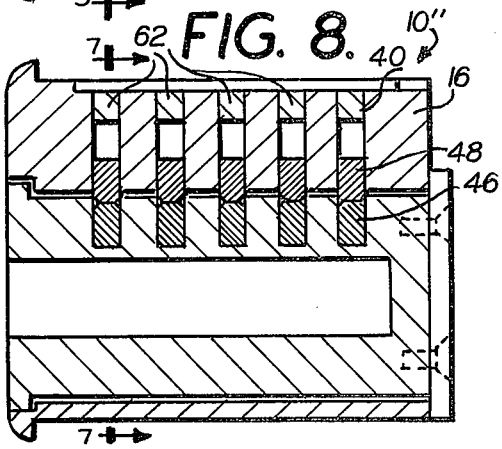
FIG. 8 is a longitudinal sectional view of the lock illustrated in FIG. 7.

Referring now to FIGS. 7 and 8, yet another modified form of lock 10'' essentially identical to the locks 10 and 10' is shown. The sole exception is in the biasing means of the lock. In the FIGS. 7 and 8 embodiment, gravity alone is used for the biasing means for the pin tumblers 46 and the drivers 48. By selecting materials, the weight of the different pin tumblers and drivers can be signficiantly varied, whereby to vary the required field strengths of the magnets 58 on the key 52 for repelling the pin tumbler magnets a proper distance to position their upper ends in the shear plane. If the magnets 58 are too strong, the pin tumblers will move into bridging relation with the shear plane and if the magnets are too weak, then the pin tumblers will not move up sufficiently to cause the drivers to move out of bridging relation with the shear plane. It should be noted in the FIGS. 7 and 8 embodiment that if through passages 40 in the shell 16 are employed, the extent of those passages may be so great as to permit the movement of the entire pin tumbler into the shell passages 40 whereby to cause the lower end to bridge the shear plane. To prevent this from occurring, it may be necessary, as shown, to insert stops 62 in the upper end of the passage 50 to limit the upward movement of the drivers 48 and the pin tumbler magnets 46.

One potential advantage in the gravity bias embodiment of FIGS. 7 and 8 is the opportunity for miniaturizing of the lock which arises from the fact that the thickness of the upper part of the shell can be reduced since there is no physical biasing means to be disposed within said thickened portion. Accordingly, this may lead to substantial savings in material and size.

It will be apparent from the foregoing description that no one lock need use the same biasing means for each magnetic pin tumbler. Thus, locks can be devised in which some of the pin tumblers are biased by magnets 50 and others by springs and still others solely by gravity. Alternatively, any two of the three described biasing means may be employed in a single lock without departing from the present invention. It will also be recognized that two or even three separate biases may act on a single pin tumbler magnet with the lock. In fact, as already noted in connection with both the FIG. 1 and FIG. 5 embodiments of the lock, two separate biasing means are operating on each individual pin tumbler magnet 46, namely, magnets 50 and gravity in the FIG. 1 embodiment and springs 60 and gravity in the FIG. 5 embodiment, although, for the purposes of simplicity of description and claiming, gravity has been ignored. Clearly, magnetic and spring biasing may be combined to operate on individual pin tumbler magnets and when that is done, gravity will also be present to further contribute to the bias assuming proper orientation of the lock.

While in the drawings, the pin tumbler magnets and the drivers are shown to be of uniform length, this is not necessary to an appropriate operation of the invention. These elements may be of different lengths and such length difference may give rise to yet another parameter for varying and required magnetic strength of the key magnets 144.

It is also recognized that individual detent means cooperating with each of the pin tumblers or drivers may be incorporated in the lock in order to ensure the proper location of the upper ends of the pin tumblers 46 in the shear planes of the locks when they have been so operated by a proper key. For example, each pin tumbler may be provided with one or a plurality of V-shaped cavities along one vertical element thereof, which V-shaped cavities will cooperate with a spring pressed pin having a V-shaped outer end that is pressed toward the pin tumbler magnets. The one cavity, or one of the plurality of cavities, is located for registering an end of the pin tumbler magnet in the shear plane. When such V-shaped cavity approaches registration with the pin, the spring force on the pin will cam the pin tumbler magnet to a predetermined vertical position. Assuming substantial balance of forces on the pin tumbler magnets such as will occur when a properly poled key magnet is in register therewith, the pin tumbler magnet will hold in the detent position for accurate alignment of the upper ends of the pin tumbler magnet with the shear plane. This will eliminate minor problems in calibrating the field strength of key magnets and biasing means. Clearly, the bias on the detect spring cannot be so great as to hold a pin tumbler magnet in its unlocked position when the key has been removed.

One of the main features of the present invention is that by adopting a magnetic lock of the structure hereinbefore described, the structure is quite similar to a conventional non-magnetic lock in physical appearance structure. The differences lie principally in the use in a magnetic lock of differing biasing forces employed for biasing the pin tumbler magnets 46 towards the keyway, coupled with the inclusion of the drivers 48. However, since the structure is similar to conventional, it will be obvious to anyone skilled in the lock making or smithing art that such a lock can be readily altered in conventional and well known manner to make it respond not only to the one key 52 as previously described, but to a second master key which can be employed for opening a large number of locks all of which are otherwise openable by different keys 52 of the type described in FIG. 3. There are well known techniques for master keying locks, such as, for example, the use of dual drivers, which are well known and which are readily adaptable to the structure described herein.

While I have herein shown and described the preferred form of the present invention and have suggested modifications therein, other changes and modifications may be made therein within the scope of the appended claims without departing from the spirit and scope of this invention.

What is claimed is:

1. In a magnetic lock including a stationary part and a movable part in surface-to-surface relation with said stationary part for movement between locked and unlocked positions, said stationary and movable parts each having a passage therein which extend away from said confronting surfaces and which are positioned for alignment and communication when said movable part is in its locked position, the improvement which comprises:

a magnetic pin tumbler slidably disposed in one of said passages and being of lesser length than said one passage;

a driver slidably disposed in the other of said passages and being of lesser length than said other passage but of greater length than the difference between the lengths of said first passage and said magnetic pin tumbler, said driver being in end-to-end relation with said magnetic pin tumbler, said driver and said pin tumbler being slidably disposed in said aligned passages for movement between a first extreme position wherein said pin tumbler straddles both said passages to prevent relative movement between said parts, a second extreme position wherein said driver straddles said two aligned passages to prevent relative movement between said parts and an intermediate unlocked position in which the confronting ends of said tumbler and said driver are coplanar with the confronting surfaces of said two parts; and means for biasing said driver and magnetic pin tumbler toward the end of one of said passages remote from the other of said passages with a predetermined force, whereby when a key is disposed adjacent one of said passages with a magnet poled to bias said pin tumbler magnet in a direction opposite said biasing means and with a force that is equal to said biasing force, then the confronting ends of said pin tumbler magnet and said driver are in said intermediate position to thereby unlock said lock.

2. The magnetic lock of claim 1, further comprising second of said passages in each of said stationary and movable plates, a second of said drivers and a second of said magnetic pin tumblers slidably disposed in said second passages in said end-to-end relation, and a second biasing means for biasing said second driver and said second magnetic pin tumbler toward the end of one of said second passages corresponding to the end of said first passages toward which said first driver and pin tumbler magnet are biased.

3. The magnetic lock of claim 2, wherein said first and second biasing means exert different biasing forces.

4. The magnetic lock of claim 1, wherein said biasing means is a magnet poled to repel said magnetic pin tumbler.

5. The magnetic lock of claim 1, wherein said biasing means is a spring.

6. The magnetic lock of claim 5, wherein said spring is a compression spring.

7. The magnetic lock of claim 1, wherein said biasing means is solely gravity.

8. The magnetic lock of claim 1, wherein said stationary part is a hollow shell having an inner cylindrical surface and said movable part is a cylindrical plug rotatably movable within said shell.

9. The magnetic lock of claim 8, wherein said passages are radially extending from said plug, and wherein said plug includes a longitudinal keyway that is out of spatial communication with said passages.

10. The magnetic lock of claim 9, wherein said pin tumbler magnet is disposed in said passages adjacent said keyway and said driver is disposed in said passages in end-to-end relation with said pin tumbler magnet and remote from said keyway, and said biasing means biases said driver and pin tumbler magnet toward said keyway.

11. The magnetic lock of claim 10, wherein said biasing means is a magnet fixed to said shell in the vicinity of the passage therein, said biasing magnet being poled to repel said pin tumbler magnet.

12. The magnetic lock of claim 11, wherein said biasing magnet is disposed in said shell passage at the end thereof remote from said plug.

13. The magnetic lock of claim 10, wherein said biasing means is a spring.

14. The magnetic lock of claim 11, wherein said spring is a compression spring disposed between the end of said driver remote from said pin tumbler magnet and the end of said shell passage confronting said remote end of said driver.

15. The magnetic lock of claim 10, wherein said biasing means is solely gravity.

16. The magnetic lock of claim 10, further comprising second of said passages in said shell and said plug, a second of said drivers and a second of said magnetic pin tumblers slidably disposed in said second passages in said end-to-end relation, and a second biasing means for biasing said second driver and said second magnetic pin tumbler toward said keyway.

17. The magnetic lock of claim 16, wherein said first and second biasing means exert different biasing forces.

18. In a magnetic lock of the type having a longitudinally extending hollow shell with a cylindrical inner surface and a longitudinally extending cylindrical plug rotatably disposed within said shell with the inner surface of said shell and the outer surface of said plug being in close confronting relation to define a shear plane therebetween, said plug being rotatably movable between locked and unlocked positions, said plug having a longitudinally extending keyway therein and a plurality of longitudinally spaced apart radially extending passages which extend from points spaced from said keyways to said shear plane, said shell having a like plurality of passages located for alignment with said plug passages when said plug is in said locked position, the improvement comprising:

a like plurality of magnetic pin tumblers, one for each plug passage, slidably disposed therein, each of said magnetic pin tumblers being of shorter length than the length of the plug passage in which it is disposed;

a like plurality of drivers, one for each magnetic pin tumbler, disposed within the shell passage alignable with the plug passage in which is disposed the associated magnetic pin tumbler, said drivers being in end-to-end relation with said magnetic pin tumbler and each being of a length less than the length of its shell passage and greater than the difference between the length of the alignable plug passage and the length of the associated magnetic pin tumbler, said associated drivers and pin tumblers being slidably disposed in said aligned passages for movement between a first extreme position wherein said pin tumbler straddles both said passages to prevent relative movement between said plug and shell, a second extreme position wherein said driver straddles said two aligned passages to prevent relative movement between said plug and shell, and an intermediate unlocked position in which the confronting ends of said tumbler and said driver are in said shear plane; and a like plurality of means for biasing said magnetic pin tumblers and said drivers toward said keyway, whereby when a key having a shank insertable in said keyway and including a like plurality of registrable magnets poled to repel the alignable pin tumbler magnets with a force equal to said biasing force exerted by said biasing means when the confronting ends of said drivers and pin tumblers are in said shear plane is disposed in said keyway with said key magnets in register with said magnetic pin tumblers, the confronting ends of associated magnetic pin tumblers and drivers will all be in said shear plane to permit rotation of said plug from said locked to said unlocked position.

19. The magnetic lock of claim 18, wherein at least two of said biasing means exert different biasing forces on their associated drivers and magnetic pin tumblers, whereby the key magnets registrable with said two magnetic pin tumblers must have different field strengths to repel said pin tumblers to place both pair of confronting ends in said shear plane.

20. The magnetic lock of claim 19, further comprising a key including a shank slidably disposed within said keyway, a like plurality of magnets mounted on said shank in register with said pin tumbler magnets, said magnets in said key shank being poled to repel the alignable pin tumbler magnets with a force equal to said biasing force exerted by said biasing means when the confronting ends of said drivers and pin tumblers are in said shear plane, whereby the confronting ends of associated magnetic pin tumblers and drivers will all be in said shear plane to permit rotation of said plug from said locked to said unlocked position.

21. The magnetic lock of claim 19, wherein at least one of said biasing means is a magnet fixedly disposed in one of said shell passages adjacent the outer surface thereof and poled to repel the magnetic pin tumbler in alignment therewith.

22. The magnetic lock of claim 19, wherein said biasing means are a like plurality of magnets, one fixedly disposed in each of said shell passages adjacent the outer surface of said shell and poled to repel the magnetic pin tumblers associated therewith.

23. The magnetic lock of claim 22, further comprising a key including a shank slidably disposed within said keyway, a like plurality of magnets mounted on said shank in register with said pin tumbler magnets, said magnets in said key shank being poled to repel the alignable pin tumbler magnets with a force equal to said biasing force exerted by said biasing means when the confronting ends of said drivers and pin tumblers are in said shear plane, whereby the confronting ends of associated magnetic pin tumblers and drivers will all be in said shear plane to permit rotation of said plug from said locked to said unlocked position.

24. The magnetic lock of claim 19, wherein at least one of said biasing means is a compression spring disposed in one of said shell passages and engaging the adjacent end of the driver therein for pressing said driver and its associated magnetic pin tumbler toward said keyway.

25. The magnetic lock of claim 19, wherein said biasing means are a like plurality of compression springs, one disposed in each shell passage and engaging the adjacent end of the drivers therein for pressing said driver and its associated magnetic pin tumblers toward said keyway.

26. The magnetic lock of claim 25, further comprising a key including a shank slidably disposed within said keyway, a like plurality of magnets mounted on said shank in register with said pin tumbler magnets, said magnets in said key shank being poled to repel the alignable pin tumbler magnets with a force equal to said biasing force exerted by said biasing means when the confronting ends of said drivers and pin tumblers are in said shear plane, whereby the confronting ends of associated magnetic pin tumblers and drivers will all be in said shear plane to permit rotation of said plug from said locked to said unlocked position.

27. The magnetic lock of claim 19, wherein said shell and plug passages when said plug is in said locked position are substantially vertical, and wherein at least one of said biasing means is solely gravity.

28. The magnetic lock of claim 19, wherein said shell and plug passages when said plug is in said locked position are substantially vertical, and wherein all of said biasing means are solely gravity.

29. The magnetic lock of claim 28, further comprising a key including a shank slidably disposed within said keyway, a like plurality of magnets mounted on said shank in register with said pin tumbler magnets, said magnets in said key shank being poled to repel the alignable pin tumbler magnets with a force equal to said biasing force exerted by said biasing means when the confronting ends of said drivers and pin tumblers are in said shear plane, whereby the confronting ends of associated magnetic pin tumblers and drivers will all be in said shear plane to permit rotation of said plug from said locked to said unlocked position.

* * * * *